US005518264A

United States Patent [19]

Broughton

[11] Patent Number: 5,518,264

[45] Date of Patent: May 21, 1996

[54] FREE HEEL/ANTERIOR RELEASE SKI BINDING

[76] Inventor: Timothy C. Broughton, 11368 S. 600 West, South Jordan, Utah 84095

[21] Appl. No.: 404,023

[22] Filed: Mar. 14, 1995

[51] Int. Cl.[6] ..... A63C 9/08

[52] U.S. Cl. ..... 280/615

[58] Field of Search ..... 280/614, 615, 280/619, 620, 621, 622, 633, 634

[56] References Cited

U.S. PATENT DOCUMENTS

| | | | |
|---|---|---|---|
| 2,831,696 | 4/1958 | Jones | 280/614 |
| 3,388,918 | 6/1968 | Hollenback | 280/614 |
| 3,877,712 | 4/1975 | Weckeiser | 280/614 |
| 3,901,523 | 8/1975 | Burger | 280/614 |
| 4,029,336 | 6/1977 | Haimerl | 280/619 |
| 4,166,634 | 9/1979 | Kirchmeger et al. | 280/614 |
| 4,322,090 | 3/1982 | Loughney | 280/615 |
| 4,887,833 | 12/1989 | Bailey | 280/615 |
| 5,224,730 | 7/1993 | Provence et al. | 280/615 |

*Primary Examiner*—Richard M. Camby
*Attorney, Agent, or Firm*—James L. Sonntag

[57] ABSTRACT

A cable ski binding comprised of a toe iron having a boot sole support and boot toe lateral movement side restraint surfaces, a toe bail for clamping the top surface of the toe end of the sole extending out from the toe end of the boot to the sole support plate, a cable for securing the boot between the said lateral side restraints and under the said toe bail, a dual purpose heel assembly having a heel lever for securing the cable to the heel of the boot and a rocker means with two opposing elongate members, one of which acts against a spring and the other having a near horizontal surface aspect and attached to the rear most end of the cable loop. Sufficient stress on the cable causes the rocker to rotate and thus allows for the effective lengthening of the cable relative to the length of the boot while being continuously opposed by an increasing torque applied to the rocker by the spring through the moment arm of the former elongate member. The same heel lever/rocker mechanism alternatively serves to releasably lock the heel of the boot down as a safety release device by levering the rear heel bail which has its lower extent fixed to the surface of the ski so that the heel is releasably clamped down on the ski; the said bail exerting a downward force an a near horizontal surface aspect of the secondary elongate member. Sufficient upward forces of the heel cause the rocker to rotate while being opposed by the spring acting on the former elongate member, until the said horizontal surface becomes nearly vertical and thus allowing the bail to slip off of the secondary elongate member surface, releasing the heel and heel lever assembly.

5 Claims, 5 Drawing Sheets

FREE HEEL/ANTERIOR RELEASE SKI BINDING

BACKGROUND OF INVENTION

1. Field of the Invention

This invention relates to ski bindings. More particularly, the invention relates to ski bindings which are adapted to be used for cross-country/telemark skiing.

2. State of the Art

Cross-country and telemark skiing are both performed with the heel of the boot free to rotate upward and forward during the skiers stride. Present bindings retain the toe of the boot sole in a rigid or semi-rigid position, and rely upon boot sole flexure to permit the boot to rotate about the toe. Alternately, the binding and the toe of the sole may rotate together.

The resurgence of telemark skiing over the past ten years has spurred an intensive developmental race for technological advancement to telemark ski equipment. In the late 1970's when "cross-country" skiers began telemark skiing at lift serviced areas, new demands were made of the cross-country ski equipment available at the time. Numerous changes were made in the boot design to make it more like that of an alpine boot including a stiffer sole and thicker leather for better torsional control and a higher, stiffer cuff. This was the birth of a new sport: telemark skiing.

Over the past ten years, many skiers have turned to telemark skiing as an alternative to alpine skiing and in so doing have made new demands on their equipment. The ski industry responded by beefing up telemark boots and bindings to support a more aggressive manner of skiing. The three-pin or traditional cable binding system, originally intended to be used in cross country skiing was restructured for telemark skiing. This restructuring included placing stiff plastic cuffs and a stiffer sole in the boots and using stronger materials for the binding in an attempt to make the telemark boot and binding system withstand the demands traditionally met by alpine skiing equipment.

There are several obvious advantages to using a telemark system which explain its recent rise in popularity in both the U.S. and Europe: (1.) Telemark equipment is very light weight, (2.) it provides for a very efficient means of mobility utilizing its flexible toe, and (3.) it performs well in skiing downhill in the free heel position through powder snow. However the use of the conventional telemark system when skiing at lift serviced resort areas, put a greater strain on the bindings and skiers legs and thus causes concern for the safety of the skier in terms of injury. Safety release bindings are becoming necessary to combat the possibility of injury in the sport of telemark skiing as flexible soled boots and binding become more rigid.

Another sport known as ski touring has also become popular over the past ten years. The object is to ski cross country (tour) to a remote destination high up in the mountains and ski downhill through uncut powder snow on possibly new and more challenging terrain in a setting away from the crowds and tracked snow conditions of the lift serviced ski area. The equipment used is either a traditional telemark boot-binding setup or what is referred to as alpine touring binding-boot setup. Alpine touring bindings consist of a plate that is hinged at the toe end of the binding with the heel free to allow for the mobility of a cross-country system while in touring mode. For the ski descent, a downhill or alpine style technique is desired and the heel end of the binding is releasably locked down. The heel lock down is made releasable to avoid skier injury.

For the telemark skier, the simple three-pin and common cable bindings in use today are still held as the best system available when the advantage of having a flexible toed boot is desired for cross-country travel and telemark skiing. However the problem with the three-pin system is that it is torsionally unresponsive to the skier, i.e., it has a certain amount of twist in the sole of the boot which makes it difficult to hold an edge on packed powder or icy slopes. The ski industry has made the boots stronger, higher, and more rigid with plastic inserts and improved structural characteristics, but the structural rigidity had not been improved appreciably until recently.

Finally, a full plastic telemark boot has been developed which has increased the stability and overall torsional rigidity of the boot. Because of this inherent stiffness of the toe of the boot it has become necessary to use a telemark cable binding system instead of the three pin binding in order to force the boot to flex at the desirable location required to perform stable telemark turns.

The improved performance of the new plastic telemark boots has brought about an urgent need for a releasable binding system which utilizes the advantages of the cable binding system. By combining a conventional release system with a conventional cable binding system the weight of the two become a considerable drawback. The weight of the conventional cable binding system is due to the heavy steel springs and cable tightening latch. These steel springs are necessary to allow the cable to be effectively lengthened or extended through the stretch in the spring but are not critical to the binding in so far as providing for a reliable high performance release The weight associated with releasable system is due to the release springs and the bulk of the heel clamping means for the anterior (forward) release system completely independent of the cable system. Combining the weights of the two systems takes away the weight advantage of using the type of free-heel systems enjoyed by the telemark skier today.

The cable systems currently on the market are some what heavy compared to the three pin binding but provide for an overall greater amount of control by biasing the ball of the foot to the ski. This downward biasing of the toe has become a necessity in using the new stiff plastic boot. The combined weight of the plastic boot and conventional cable binding makes it considerable heavier and therefor less desirable for back country or non-lift serviced area touring.

The binding of the present invention eliminates the need for these springs by providing a much lighter and effective cable extension means and cable tightening means. It is able to reduce the weight of the cable system of the invention by nearly ½ as compared to conventional cable bindings available. It also incorporates a anterior safety release system without adding any additional weight to the cable system by utilizing the cable extension mechanism. This weight reduction not only makes the new design lighter overall as compared to the telemark cable binding but provides for the same safety feature and ability to lock the heel of the boot down for an alpine descent as found in alpine touring binding systems at a small fraction of the weight.

OBJECTS OF THE INVENTION

An object of the invention is to provide a ski binding system for attaching one of a flexible, semi-flexible, and rigid ski boot to an elongate ski having a longitudinal axis, with the heel of the said boot free relative to the ski and alternatively with the heel in the locked down position.

Another object of the invention is to provide a ski binding system that is light in weight.

Another object of the invention is to provide a ski binding system that provides safety features as in conventional alpine or alpine touring release bindings.

Other objects of the invention will become evident from the description that follows.

SUMMARY OF THE INVENTION

An embodiment of the invention is a cable ski binding system for attaching a ski boot to an elongate ski having a longitudinal axis, a front end, and a rear end, a toe iron with a means for attachment to the ski, the toe iron having a surface for supporting sole of said boot and means for restraining lateral motion of the toe end of said ski boot;

a toe clamping means for clamping to the toe iron a boot toe portion of the sole that extends out from the toe end of the boot, the clamping means connected to said lateral restraint means such that the combination of the toe clamping means and the restraint means restricts the upward and lateral movement of the boot toe.

a cable extension allowance means having a rocker and a heel lever, the heel lever including a clamping surface for removable attachment to a portion of a heel of a boot sole that extends out from the heel end of the boot, the rocker pivotally attached to the heel lever along a pivot axis substantially perpendicular to the longitudinal axis of the ski, the rocker having a first elongate member and a second elongate member, the first member acting against a spring means to provide a torque around the pivot axis to resist movement of the second elongate member of the rocker, the spring means being one of a helical coil spring, cantilever leaf spring, or coil spring providing the said torque to the rocker around the pivot axis of the rocker in order to resist movement of the second elongate member of the rocker; a flexible cable loop passing from an attachment on the secondary elongate member around the lateral restraint means on the toe iron and back to the attachment so as to secure to the toe iron a toe of a boot sole between the lateral restraint surface means and under the toe clamping means; the attachment on the secondary elongate member disposed at a distance away from the pivotal axis and rotationally offset from the clamping surface of the heel lever, such that upon upward movement of the heel of the boot the rocker rotates about the axis counter to the torque applied by the spring means and moves the attachment of the cable means toward the boot toe, thereby increasing the effective length of the flexible cable loop;

a safety release means, for attachment of the cable allowance means to the upper surface of the ski, the release means having a release bail with a lower end fixed to the ski near the heel end of the boot and an upper end supported on a substantially horizontal platform surface of the second elongate member of the rocker, such that upon sufficient upward movement of the heel of the boot sufficient counter-torque is applied to the rocker to cause the rocker to sufficiently rotate against the torque produced by the spring, such that the said horizontal platform surface travels sufficiently toward the vertical to allow the said bail to slip off of the said elongate member's platform surface, and thereby releasing both the heel end of the boot and said heel lever assembly and allowing upward release of the heel end of the boot.

The constituents of a typical cable binding system include a toe clamp, a set of boot toe lateral movement restraint side supports, a discontinuous cable heel loop, a cable heel loop tightening devise typically in the form of a latch or buckle type mechanism, and a stretch/extension allowance spring incorporated into the cable loop. The function of the said cable is to force the toe of the boot under the toe clamp and wedge the boot toe between the lateral movement restraint means. The cable loop extends from the heel of the boot where its ends are connected to the effective cable lengthening allowance spring, towards the toe end of the boot where it is connected to the said side restraints means. The cable is fixed at the said side restraint means at a point near the ball of the foot by a bracket mounted on the side supports just in back of where the toes are allowed to flex, so as to allow the heel of the boot to rise freely above the ski.

A telemark turn or free heel ski turn is performed by dropping one foot back behind the other, bending at the knee and ball of the foot so that the heel of the trailing foot is raised with the leading foot heel down while the forward ski executes the turn. The skier's trailing or rear foot "rides" the ski supported by the ball of the foot acting on the top surface of the ski. Having the ball of the foot rearward and in contact with the ski in this manner affords the greatest amount of anterior and posterior stability and control while skiing downhill with the heel free. In many instances, however, the ball of the said raised heel foot must be allowed to lose contact with the surface of the ski and raise up. In such an instant the skier will "roll" up upon the tips of the toes. By connecting the cable to the heel of the boot, the ball of the skiers foot is biased down to be in contact with the ski surface while allowing for the said rolling or flexing forward onto the toes when excessive forces dictate. In order to allow for this, the cable becomes effectively longer or extended by virtue of the stretch in a spring or set of springs connected in line with the cable.

To secure the boot in the binding the cable is tightened around the boot forcing the standardized toe to be wedged securely between the said side supports and under the toe clamp. The cable tightening devise is typically located either in front of the binding pulling the cable forward, and thus pulling the boot into the toe plate or alternatively located on the side of the boot where the latch serves to effectively tighten the loop of cable around the boot and thus pretensioning the springs.

The binding of this invention is a cable binding system which serves the same functional principles as the common cable binding as described above, but it does so with a unique and innovative approach. It also combines the means for cable extension with the means for an anterior (forward) safety release into one mechanism and thus eliminates the majority of the weight associated with the cable binding-safety release combination.

In an alternate embodiment of the invention, the flexible cable loop may be eliminated. In this embodiment, the binding would be used for down hill skiing using the safety release feature as described above.

DETAILED DESCRIPTION OF THE INVENTION

The features of the binding of the invention are more readily defined with reference to the drawings.

Figure 1:
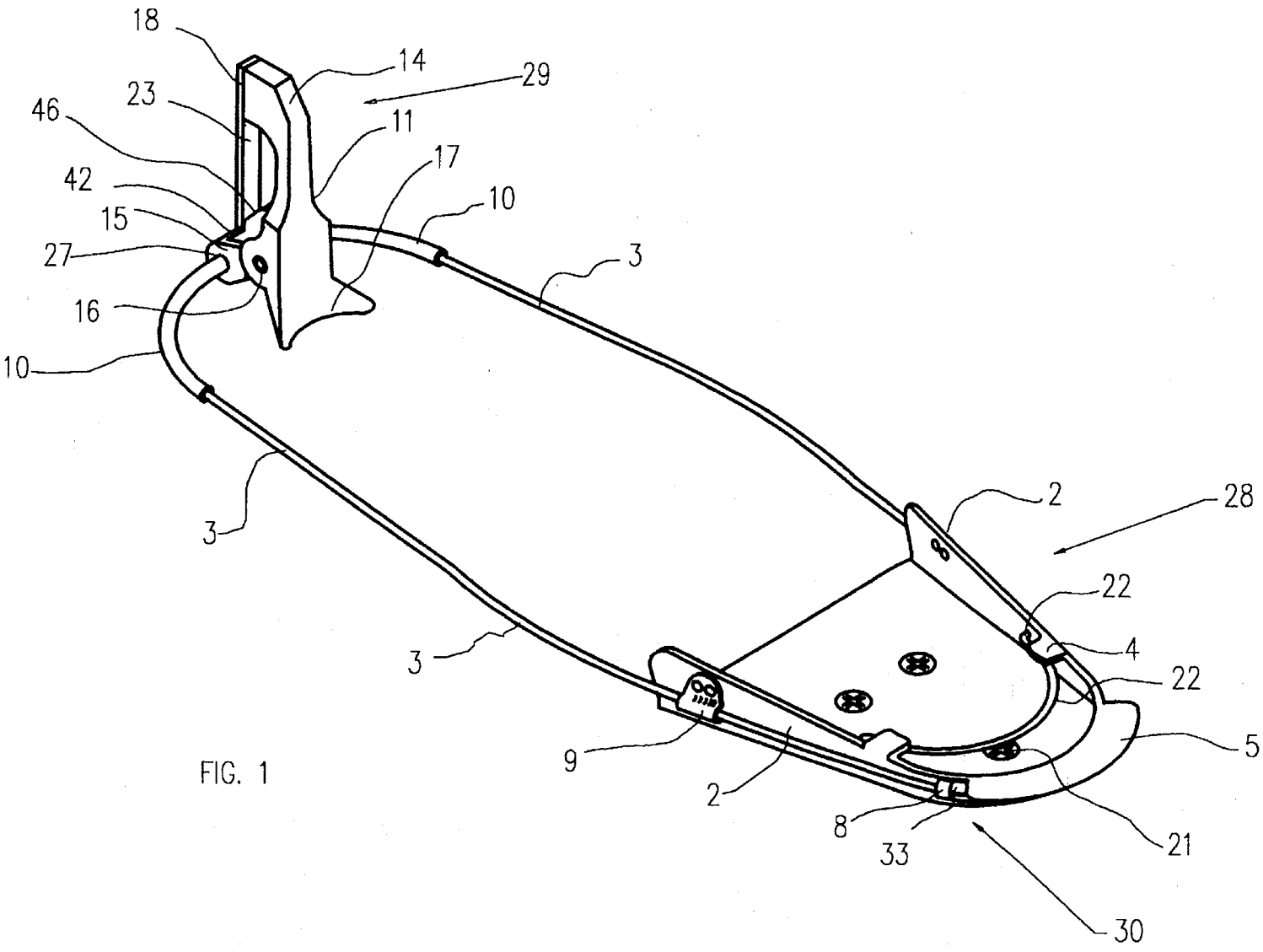
FIG. 1. is a perspective view of the cable binding system without boot.

FIG. 1 shows the ski binding system 27, of the invention attached to the top side 19, of ski 20 with the ski boot, not shown. The subsystems of the cable binding system 27 shown in FIG. 1 are comprised of the toe plate lateral restraint group subsystem 28, the heel lever/rocker mechanism subsystem 29, and the cable length adjustment assembly subsystem 30.

The toe plate lateral restraint subsystem 28 is comprised of a lateral boot movement restraints plate 1, lateral movement restraints walls 2, a toe clamp bail 6, bail pivot movement limiter tab 4, mounting screw 21, cable loop 3, cable securing clamps 9. The cable loop 3 is situated such that it forms a complete loop around the heel of the boot 26, and around the furthest toe end extent of the said toe lateral restraints plate 1 portion of the binding and securely wedged under the toe restraint flange 5 (through the boot size adjustment subsystem 30 below).

At the toe end of the binding 27, is a boot size cable length adjustment means subsystem 30, comprised of length adjustment tubing 7, cable end swages 8, cable end threaded screw/swage 32, and tubing end collars 33. At the rearward or heel extent of the cable is a heel lever, rocker, mechanism subsystem 29. Details of components of the two subsystem 30 and 29, described above are illustrated in FIGS. 7 and 2 respectively.

Figure 2:
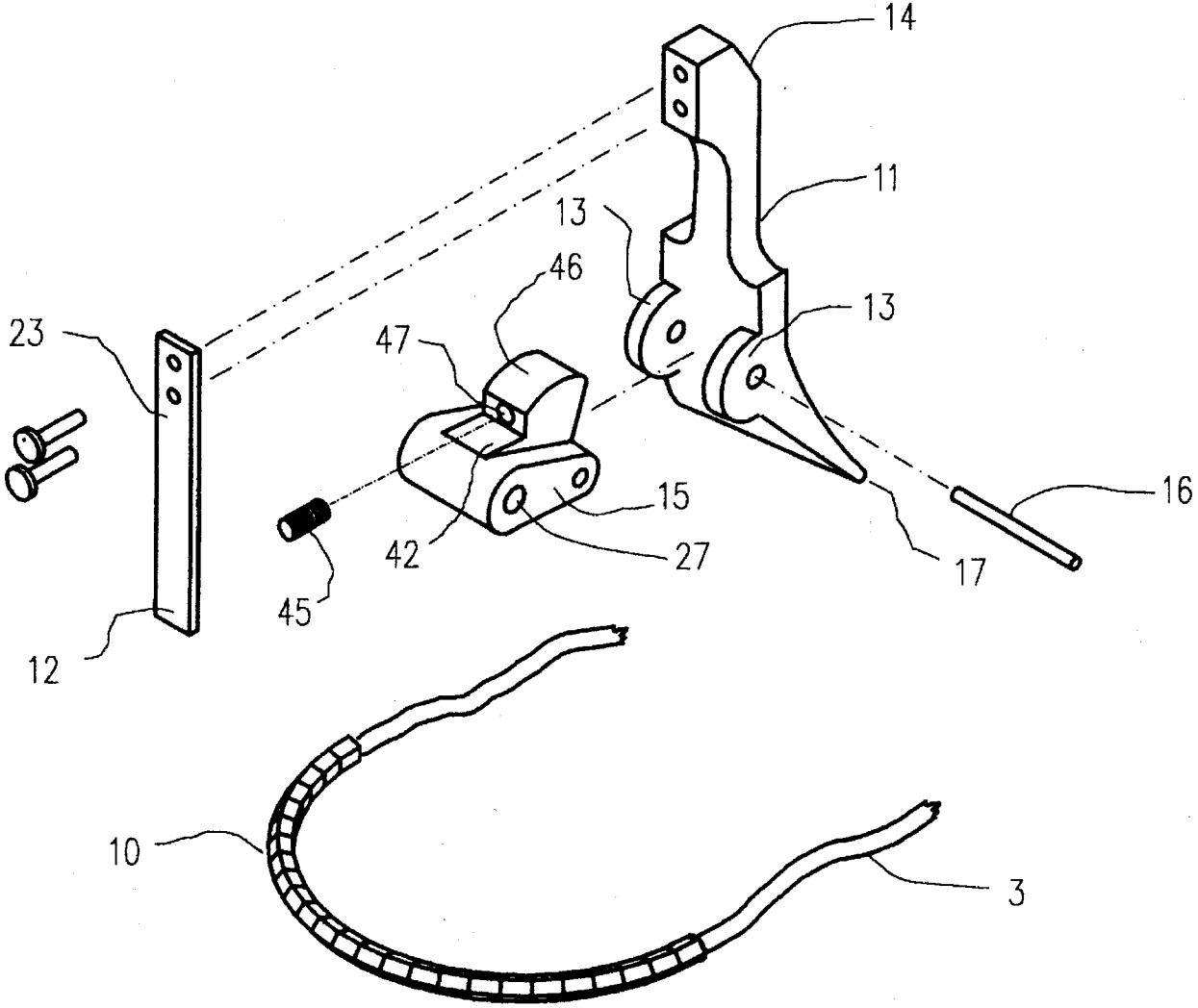
FIG. 2 is an exploded view of Heel Mechanism.

FIG. 2 shows an exploded view of the heel lever rocker mechanism, subsystem 29, with an isometric view of each component. The said heel lever-rocker mechanism constituent parts are the heel lever 11, cable extension rocker 15, pivot axis pin 16, cable form stiffener 10 surrounding cable 3, and cable-extension-allowance/anterior release cantilever leaf spring 23 and an anterior safety release tension adjustment screw 45. Surface aspects of the rocker 15, shown in FIG. 2, are the cam-cantilever contact surface 46, the anterior release bail platform 42 and said bail point of contact 43 (shown in FIG. 5).

The subsystems work in cooperation to provide an improved means of boot lateral restraint and boot retention (avoidance of boot torque-out), and a heel or anterior release capability without any additional weight as well as a substantial reduction in overall weight as compared to conventional cable binding systems or cable binding/release combinations developed to date.

Some of the unique and advantageous features of the binding of this invention are: (a.) the toe clamp or toe bail 6, part of the said lateral restraint subsystem 28, which affords the use of a stiff, full shank alpine touring boot as well as a flexible toed telemark boot, (b.) The simplicity and light weight afforded by the cable length adjustment subsystem 30, (c.) a heel lever/rocker mechanism 29, which is used for securing the boot 24, to the binding by engaging the heel of the boot and using the leverage of the heel lever to forcibly wedge the toe of the boot 25, between the lateral restraints 2, and under the bail 6; d) the heel lever in conjunction with the heel lever rocker, 15, also provides the means for the cable extension allowance discussed in the "Summary" section, which serves to forcibly bias the ball of the raised-heel foot down to the surface 19, of the ski 20, forcing the toe of the boot to bend while executing a telemark turn, and most importantly, e.) provide for a state-of-the-an anterior release function without adding any considerable weight to the existing cable binding system.

Figure 3:
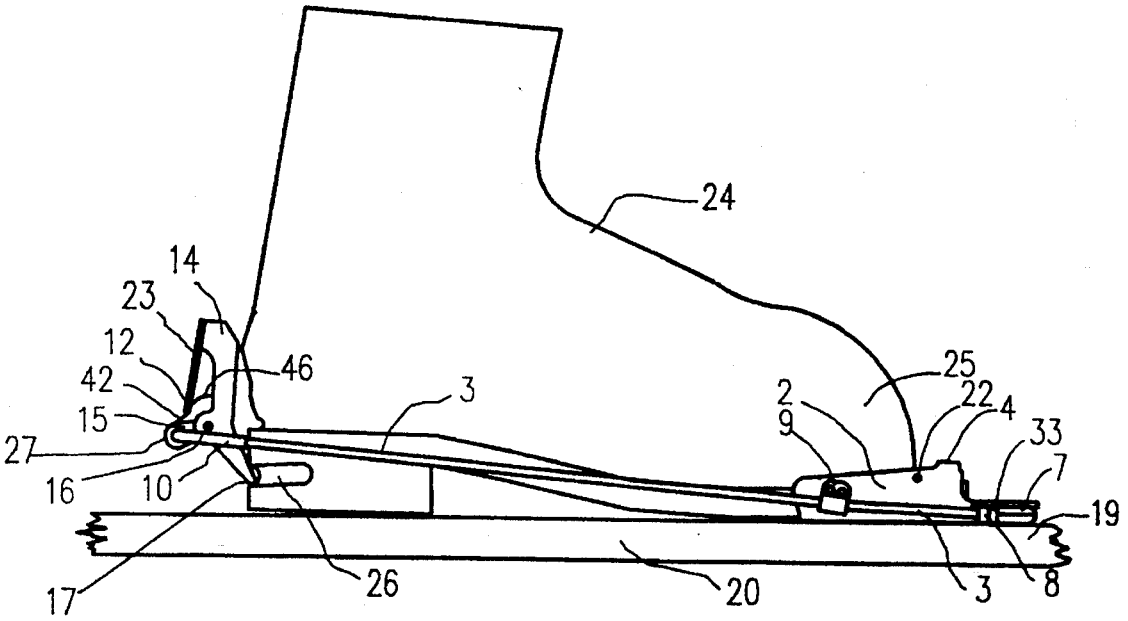
FIG. 3. is a side view of binding engaging boot between bail and heel mechanism in preloaded position.

Shown in FIG. 3, the binding of the invention uses a heel lever 11, to engage the heel groove 26, of the boot 24, and secures the boot to the binding by tightening the cable 3, around the boot, wedging the toe 25 of the boot, between the lateral movement restraints 2, of the toe plate 1, and forcing the toe, under the toe bail 6, thus securing the toe down. The elastic means provided by the cantilever spring 23, in FIG. 2 is in pre-loaded position so as to hold the boot in the binding securely when the heel is down.

Figure 4:
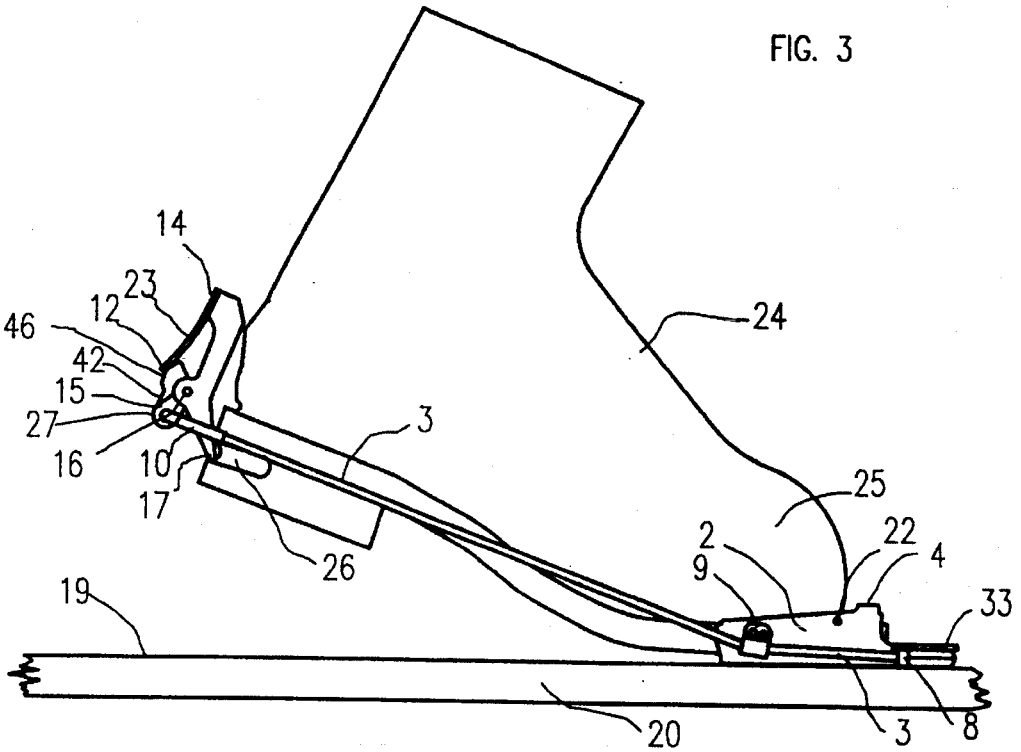
FIG. 4. is a side view heel mechanism and boot with heel raised showing motion of rocker in loaded position for cable extension allowance.

FIG. 4 shows the heel of the boot raised, causing the heel end of the cable 3, to be extended, or effectively lengthened by forcing the lower extent of the rocker 27, to be rotationally displaced relative to the heel of the boot, to accommodate the upward stress applied to the ball of the foot by the boot's raised heel 26. The lengthening of the cable-spring loop caused by the ball of the foot being raised off the ski 20, shown in FIG. 4, is made possible by the displacement of the lower extent 27, of the rocker. The rocker is situated on the rear side of the heel lever 11, with the middle section of the rocker fixed pivotally about a longitudinal axis 16, and between the lever yoke 13.

The upper extent 46, of the rocker 15, is elastically held in place against the cantilever leaf spring 23 which is rigidly attached to the upper most extent 14 of the heel lever 11. The cable is connected to the lower most extent 27, of the rocker. In FIG. 3, the lower portion 27 of the rocker 15, is slightly displaced counter clockwise so as to pre-load the cable in tension. The leaf spring 23 acts as a cantilever beam which biases the rocker against counter-clockwise rotational displacement when tension is applied to the said lower extent of the rocker by the cable 3. When the torque applied to the rocker is increased by the cable, further rotational displacement of the rocker is opposed with increasing resistance by the reaction of the leaf spring 23 acting on the rocker's upper extent cam surface 46. As the rocker rotates counter-clockwise the cam 46, causes the cantilever to deflect producing a reactive force acting on the said cam. As the said springs deflection increases the applied torque resisting cable extension increases. When excess stress is applied to the cable 3—i.e. the heel is raised to the extent of raising the ball of the foot—the rocker is caused to rotate about the longitudinal axis 16, allowing for the necessary relative extension of the said cable. The system allows the cable to in effect lengthen as the position of the cable relative to the heel 26 is displaced by the rotation of the rocker. It serves the function of the helical coil spring in the previously mentioned conventional cable binding.

The above described cable stretch allowance means serves to eliminate much of the weight associated with the heavy steel spring common to conventional cable binding systems while sustaining the capability for cable extension allowance. It also eliminates the interference between boots while skiing caused by the presence of bulky springs sticking out on the sides of the boots. The new binding system lever rocker mechanism 29, is contained behind the back of the heel with only the thin cable exposed along the sides of the boots. It is worth while noting that the said rocker cam shape may be designed to produce any progression of cable extension resistance desired. For instance: pre-loaded can initially be made to be very high so as to resist early "twist-out" from the binding which is common with the heel in the lowered position, and subsequent cable extension resistance progression to be gradual (non-linear). The common cable extension allowance spring has no such capability considering that the extension progression of a uniform helical coil springs used in conventional cable binding systems are always linear.

Figure 5:
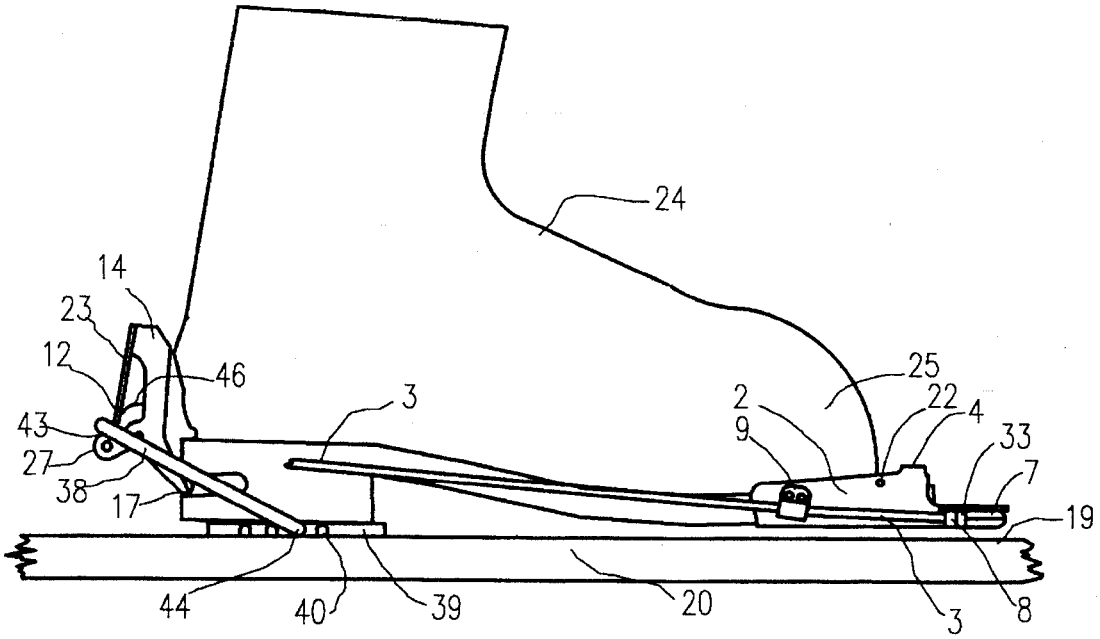
FIG. 5 is a side view of Anterior Release function detail in pre-loaded position
Figure 6:
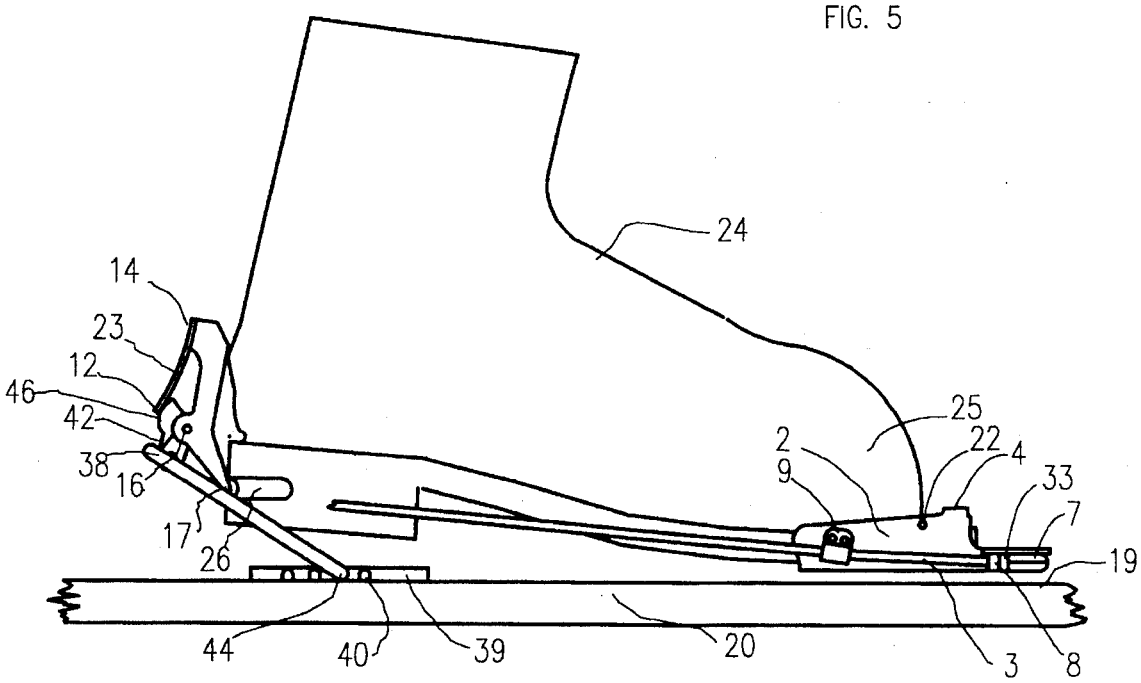
FIG. 6 is a side view of Anterior Release function detail with release motion in progress.

The above described rocker/heel lever subsystem 29 also functions as an anterior (forward) safety release system when used with a simple heel bail 38 as shown in FIGS. 5 and 6. The said heel bail is pivotally fixed to the ski surface with the heel platform 39. The axis about which the bail pivots, adjacent to the ski is adjustable by raising the heel platform 39, and positioning the lower part of the bail 44 in the correct one of the grooves 40 on the underside of the said plate and tighten the securing screws 41. The bail is positioned so that the top of the bail can be hooked by the rocker 15 and levered, by the heel lever 11 acting on the boot heel 26, onto the top surface of the bail platform 42, of the rocker, resulting in clamping the heel of the boot 26 to the ski. With the bail levered onto the rocker surface 42 the boot will be releasably secured to the ski surface 19 for skiing alpine (downhill) technique. The top crossbar of the bail is to contact the surface of the rocker 42 such that the moment arm extending from the rocker pivot axis 16 to the point of contact 43 of the bail, be much smaller than the moment arm extending from the said rocker pivot axis 16, to the cable connection center 27. When excessive force is applied to the binding by the heel of the boot, in the case of a skiers fall with the vertical motion of the heel impending, the bail forces the rocker to rotate and thus causes the cantilever leaf spring 23, to deflect until the rocker has rotated to a position for which the release bail platform surface 42 is vertical. When surface 42 becomes vertical the rocker can no longer support any of the vertical reactive forces of the bail and thus the rocker is freed from the bail and the heel is released. Since the cable system 27 is still connected to the boot 24, once the rocker clears the bail the rocker is free to rotate almost instantaneously to reapply the previous tension on the cable 3 by the cantilever spring 23 and thus resume the capability to execute telemark turns. The anterior release does not actually completely release the boot from the binding under normal conditions but allows the heel to be raised to prevent injury.

The tension required for release can be adjusted by varying the bail point of contact 43, on the release bail platform surface 42 of the rocker with the tension adjustment screw 45. The said adjustment screw's center axis is aligned parallel and offset from the release bail platform surface 42 and perpendicular to the rocker pivot center 16. The adjustment is made by unscrewing the screw 45 from the rocker through the threaded hole 47, at the furthest inset portion of the release bail platform surface 42. The tension on the release will be a function of the length of the moment arm from the rocker pivot center 16, to the bail point of contact 43. Tension is determined by the leverage of the bail acting on the rocker 15 at point 43, as compared to the leverage of the portion of the cam contact surface 46 forcibly acted on by the cantilever leaf spring 23. The torque required for release can be varied by adjusting the screw 45 to the desired position so that the bail is offset from the rocker pivot center 16. By varying the moment arm length between the release bail point of contact 43 and the rocker center 16 with the adjustment screw, the desired torque can be selected to meet the safety requirements for different skiers.

Figure 7:
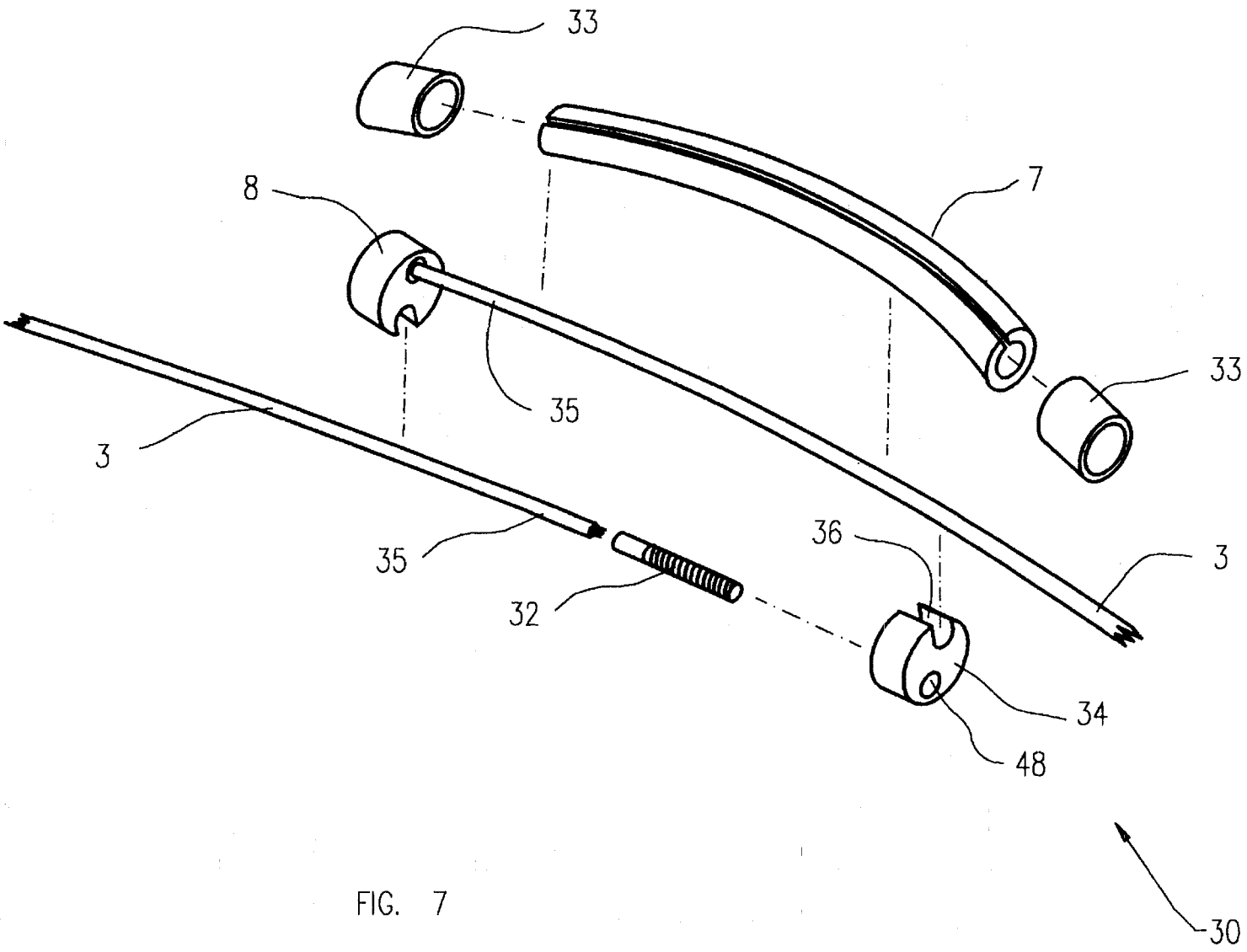
FIG. 7. is an exploded view of the boot size adjustment assembly.

Boot size cable length adjustment means subsystem 30, is comprised of length adjustment tubing 7, cable end butt swage 8, threaded cable end butt 34, swaged cable end screw 32, and tubing end collars 33. FIG. 7 shows the exploded view of the cable length adjustment means. At the toe end of the boot the cable ends wrap around the nose end of the lateral boot restraint subsystem 28, tucked under the said restraint plate flange. One end of the cable is swaged with the cable end butt swage 8, while the other is connected to the cable end screw which is screwed into the threaded hole 48, of the threaded end butt 34. With the end butts fixed to the ends of the cable the extending lengths 35 are fitted into the elongated troughs 36 of the end butts 8 and 34. The length adjustment tubing 7 which has a slit 37 along its length is fitted around the two extended lengths of cable 35 through the said slit. The said tubing acts as a compressive member between the end butts when tension is applied to the cable. By varying the length of the tubing the cable loop can be adjusted to accommodate the desired size of boot. The ends of the slit tubing 7, are secured by the tubing end collars 33 to prevent the ends of the tubing from splitting from the pressure of the end butts and thus ensuring the integrity of the tubing as a compressional member. Gross adjustments are accomplished by varying the length of the tubing by means of selecting the proper length of tubing. Fine adjustment for the size of the loop can be accomplished by turning the threaded cable end butt 34 around the swaged cable end screw 32 till the proper level of cable pretension is reached.

While this invention has been described with reference to certain specific embodiments and examples, it will be recognized by those skilled in the art that many variations are possible without departing from the scope and spirit of this invention, and that the invention, as described by the claims, is intended to cover all changes and modifications of the invention which do not depart from the spirit of the invention.

What is claimed is:

1. A cable ski binding system for attaching a ski boot to an elongate ski having a longitudinal axis, a front end and a rear end a toe iron with an attachment means for attachment to the ski, the toe iron having a surface for supporting sole of said boot and lateral restraint means for restraining lateral motion of the toe end of the said ski boot:

a toe clamping means for clamping to the toe iron a boot toe portion of the sole that extends out from the toe end of the boot, the clamping means connected to said lateral restraint means such that the combination of the toe clamping means and the lateral restraint means restricts the upward and lateral movement of the boot toe;

a cable extension allowance means having a rocker and a heel lever, the heel lever including a clamping surface for removable attachment to a portion of a heel of a boot sole that extends out from the heel end of the boot, the rocker pivotally attached to the heel lever along a pivot axis substantially perpendicular to the longitudinal axis of the ski: the rocker having a first elongate member and second elongate member, the first member acting against a spring means attached to said heel lever to provide a torque around the pivot axis to resist movement of the second elongate member of the rocker toward the front end of the ski;

a flexible cable loop passing from an attachment on the secondary elongate member around the lateral restraint means on the toe iron and back to the attachment so as to secure to the toe iron a toe of a boot sole between the lateral restraint means and under the toe clamping means; the attachment on the secondary elongate member disposed at a distance away from the pivotal axis and rotationally offset from the clamping surface of the heel lever, such that upon upward movement of the heel of the boot the rocker rotates about the axis counter to the torque from the spring means and moves the attachment of the flexible cable loop toward the boot toe, thereby increasing the effective length of the flexible cable loop;

a safety release means, for attachment of the cable extension allowance means to the upper surface of the ski, the release means having a release bail with a lower end fixed to the ski near the heel end of the boot and an upper end supported on a substantially horizontal platform surface of the second elongate member of the rocker, such that upon sufficient upward movement of the heel end of the boot sufficient counter-torque is applied to the rocker to cause the rocker to sufficiently rotate against the torque produced by the spring, such that the said horizontal platform surface travels sufficiently toward the vertical to allow the said bail to slip off of the said elongate member's platform surface, and thereby releasing both the heel end of the boot and said heel lever assembly and allowing upward release of the heel end of the boot.

2. The ski binding system of claim 1 wherein the spring means is a cantilever leaf spring with an upper end fixedly attached to an upward extension of the heel lever and a lower free end extending down towards the upper surface of the ski with the free end acting against the said first elongate member to provide the torque around the pivot axis that resists movement of the second elongate member of the rocker toward the front end of the ski.

3. The ski binding system of claim 1 wherein the spring means is a helical coil spring with a stationary end and a free end, with the stationary end supported against a supporting means fixed to the heel lever and the free end supported by the first elongate member of the rocker, with the free end acting against the first elongate member to provide the torque around the pivot axis that resists movement of the second elongate member of the rocker toward the front end of the ski.

4. The ski binding system of claim 1, wherein the toe restraint means comprises a toe bail attached at its end points to the lateral restraint means, the toe bail supporting the toe end of the boot laterally by forming an arcing contour around the front of the boot toe such that the protruding sole is clamped at the toe end of the boot under the curved portion of the said toe bail.

5. A cable ski binding system for attaching a ski boot to an elongate ski having a longitudinal axis, a front end and a rear end a toe iron with an attachment means for attachment to the ski, the toe iron having a surface for supporting sole of said boot and lateral restraint means for restraining lateral motion of the toe end of the said ski boot:

a toe clamping means for clamping to the toe iron a boot toe portion of the sole that extends out from the toe end of the boot, the clamping means connected to said lateral restraint means such that the combination of the toe clamping means and the lateral restraint means restricts the upward and lateral movement of the boot toe;

a heel lever including a clamping surface for removable attachment to a portion of a heel of a boot sole that extends out from the heel end of the boot, a rocker pivotally attached to the heel lever along a pivot axis substantially perpendicular to the longitudinal axis of the ski, the rocker having a first elongate member and second elongate member, the first member acting against a spring means attached to said heel lever to provide a torque around the pivot axis to resist movement of the second elongate member of the rocker toward the front end of the ski;

a safety release means, for attachment of the rocker to the upper surface of the ski, the release means having a release bail with a lower end fixed to the ski near the heel end of the boot and an upper end supported on a substantially horizontal platform surface of the second elongate member of the rocker, such that upon sufficient upward movement of the heel end of the boot sufficient counter-torque is applied to the rocker to cause the rocker to sufficiently rotate against the torque produced by the spring, such that the said horizontal platform surface travels sufficiently toward the vertical to allow the said bail to slip off of the said elongate member's platform surface and thereby releasing both the heel end of the boot and said heel lever assembly and allowing upward release of the heel end of the boot.

* * * * *